United States Patent [19]

Wrulich et al.

[11] 4,456,306

[45] Jun. 26, 1984

[54] COOLING SYSTEM FOR COOLING THE BITS OF A CUTTING MACHINE

[75] Inventors: Herwig Wrulich; Alfred Zitz; Otto Schetina; Siegmar Gekle, all of Zeltweg, Austria

[73] Assignee: Voest-Alpine Aktiengesellschaft, Vienna, Austria

[21] Appl. No.: 353,936

[22] Filed: Mar. 2, 1982

[30] Foreign Application Priority Data

Mar. 12, 1981 [AT] Austria ..... 1135/81

[51] Int. Cl.[3] ..... E21C 35/22

[52] U.S. Cl. ..... 299/81

[58] Field of Search ..... 299/81, 17; 175/67, 175/243

[56] References Cited

U.S. PATENT DOCUMENTS 4,333,687 6/1982 Barnstorf ..... 299/81

FOREIGN PATENT DOCUMENTS 685821 9/1979 U.S.S.R. ..... 299/81

*Primary Examiner*—Ernest R. Purser
*Assistant Examiner*—Thuy M. Bui
*Attorney, Agent, or Firm*—Cushman, Darby & Cushman

[57] ABSTRACT

The invention refers to a system for cooling the bits of a cutting machine and comprising a nozzle for the cooling water to be ejected under pressure, said nozzle being arranged at the area of the bit, the water supply to said nozzle being closable by means of a shutoff valve and the bit being supported on the bit holder for limited axial shifting movement under the action of the cutting pressure against the force of a spring and against the hydraulic pressure of the cooling water and the shutoff valve being coupled with the bit by means of a coupling member such that the shutoff valve is opened on shifting movement of the bit in direction of the cutting pressure. In this system the arrangement is such that the bit (6) has in a manner known per se the shape of a cap and is enclosing a bit shaft (3) adapted to be inserted into the bit holder (1), in that the cap-shaped bit (6) is supported on the shaft (3) for shifting movement in axial direction and in that the shutoff valve (11) and the coupling member (10) are arranged within the bit shaft (3). The coupling member is formed of a push rod (10) acting on the closure member (11) of the valve, said push rod being guided within a central bore (9) of the bit shaft and the closure member (11) closing the valve in opposite direction to the action of the cutting pressure and being moved in open position by the push rod (10) in direction of the acting cutting pressure.

11 Claims, 1 Drawing Figure

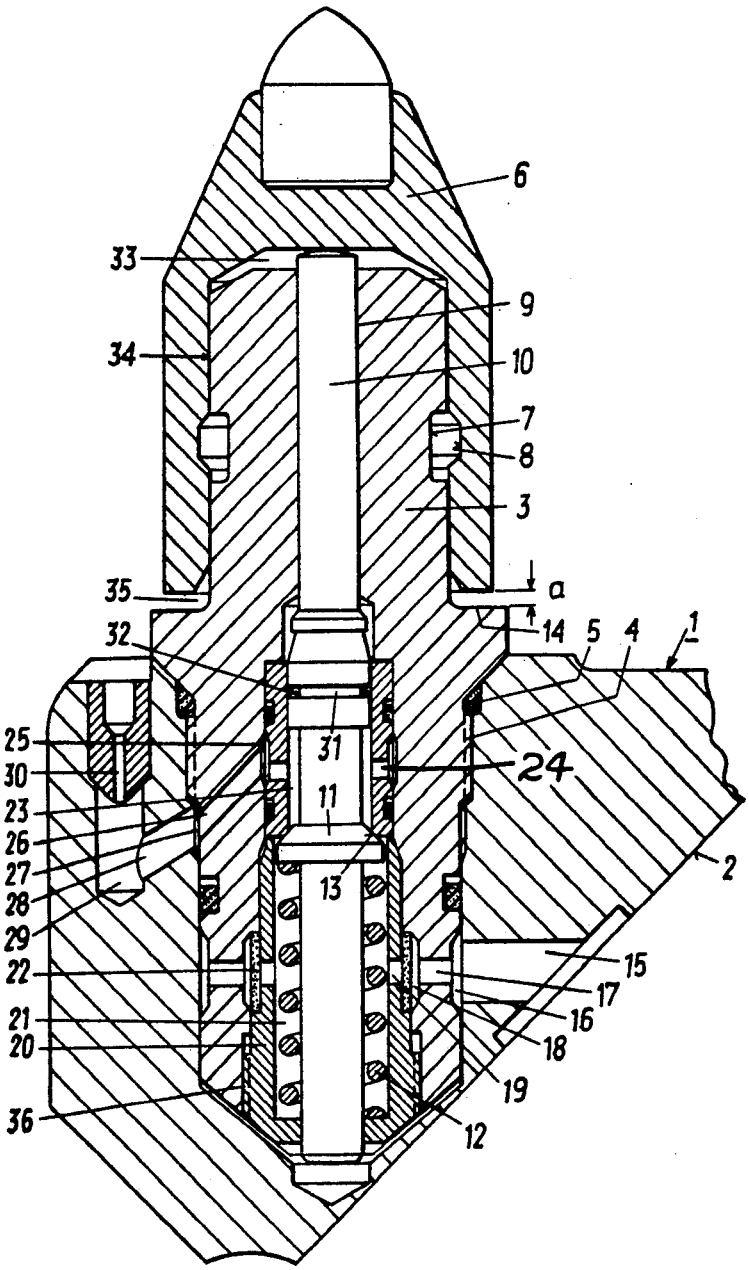
6
33
9
34
10
7
8
3
35
a
32
14
5
4
1
25
31
24
30
11
23
26
27
2
28
13
29
15
22
17
16
21
18
20
19
36
12

COOLING SYSTEM FOR COOLING THE BITS OF A CUTTING MACHINE

SUMMARY OF THE INVENTION

The invention refers to a system for cooling the bits of a cutting machine and comprising a nozzle for the cooling water to be ejected under pressure, said nozzle being arranged at the area of the bit, the water supply to said nozzle being closable by means of a shutoff valve and the bit being supported on the bit holder for limited axial shifting movement under the action of the cutting pressure against the force of a spring and against the hydraulic pressure of the cooling water and the shutoff valve being coupled with the bit by means of a coupling member such that the shutoff valve is opened on shifting movement of the bit in direction of the cutting pressure. Such a system provides the possibility to limit ejection of the cooling water out of nozzle to that time interval during which a bit considered is engaging the rock. Ejection of cooling water is interrupted during that time interval during which the bit considered is not effecting cutting work so that the amount of cooling water required is substantiuly reduced. This does not only provide the advantage to reduce the water consumption but also provides the advantage that the floor becomes not excessively soaked by the water ejected. In an known system of the mentioned type, the bit shaft is supported within the bit holder for shifting movement against the force of a spring and is engaging with an integral collar the coupling member actuating the shutoff valve. This coupling member must be arranged on the external surface of the bit holder and is subjected to becoming damaged on cutting operation.

The invention now aims at making the actuation of the shutoff valve reliable in operation and to prevent the actuating members from becoming damaged. For this purpose, the invention essentially consists in that the cap-shaped bit is supported on the shaft for shifting movement in axial direction and in that the shutoff valve and the coupling member are arranged within the bit shaft. Cap-shaped bits enclosing the bit shaft and being rotatably arranged on the bit shaft in its turn non-rotatably inserted into the bit holder are known perse. In view of the coupling member being arranged within this bit shaft, the coupling member is by the cap-shaped bit prevented from becoming contaminated and damaged. By arranging the shutoff valve itself also within the bit shaft there results a simple construction because all complicated constructional parts are arranged within the bit shaft which is protected by the cap-shaped bit. It is now only required to provide the bores for supplying the cooling water to the nozzle within the bit holder. According to a preferred embodiment of the invention the arragement is such that the shutoff valve opens in direction of the acting cutting pressure and that the bit shft has a central bore within which a push rod forming the coupling member is guided for shifting movement in axial direction, said push rod acting on the movable closure member of the valve and optionally being integral with said closure member. In this manner the coupling member can be given a simple construction. The movable closure member of the valve is conveniently formed of a valve cone but can also be formed of a ball. Finally it is also possible to give the movable closure member the shape of a slide which is by the coupling member shifted in open position relative to the slide face whenever the cutting pressure becomes effective.

According to the invention the arrangement is preferably such that the movable closure member is opening in direction of the cutting pressure and the spring acting on the bit in opposite direction to the cutting pressure is formed of the spring acting on the movable closure member. In this case one can do with a spring maintaining the valve in closed position as well as loading the bit in opposite direction to the cutting pressure. According to the invention, the valve housing is preferably a tubular valve housing and inserted into a central bore of the bit shaft. This arrangement provides for a simple design of the bit shaft, working of the bit shaft being reduced to simple latching and drilling operation.

The cap-shaped bit is to be rotatably supported on the bit shaft and it is therefore essential that the bit can actually rotate during operation and becomes not blocked by dust and contaminating matter penetrating into the gap between shaft and bit because in such a case the accuracy of the cutting work effected by the bit would be questionable. A certain but small gap between the inner wall of the cap-shaped bit and the bit shaft can not be avoided and results in the danger that dust and other contaminating matter accumulates within this gap and obstructs rotating movement of the bit. To avoid such a danger it is, according to the invention, convenient that the push rod is untightly guided within the bore of the bit shaft and within a guide bore of the valve housing. With this arrangement, the water is allowed to flow out of the valve and along the push rod to the annular gap existing between the bit and the bit shaft, whereby this annular gap becomes rinsed and contaminations having entered this annular gap are discharged in outward direction. This makes sure that the bit is easily rotatable on the bit shaft. In this connection and according to the invention a slotting ring, particularly a sealing ring, is preferably inserted between the push rod and the guide bore of the valve housing, the slit of said slotted ring providing a flow passage for the water. By suitably dimensioning this slot, the amount of water emerging can be limited to the minimum amount required for rinsing the annular gap.

BRIEF DESCRIPTION OF THE INVENTION

The invention is further discribed with reference to an embodiment of the invention shown in the drawing in an axial section through the bit and through the bit shaft as well as through the bit holder.

DESCRIPTION OF THE PREFERRED EMBODIMENTS

The bit holder 1 is welded with its surface 2 to the cutting head. A bit shaft 3 is inserted into the bit holder 1, i.e. screwedly engaged therein by a thread 4. 5 is a sealing. A cap-shaped bit 6 is rotatably supported on the bit shaft 3. An annular space receiving a securing ring is provided by an annular groove 7 within the bit shaft and by an annular groove 8 in the cap-shaped mantle of the bit 6. The annular grove 7 has a greater axial width than the securing ring provided therein so that the bit 6 is axially shiftably supported on the bit shaft.

A push rod 10 is axially shiftably guided within a central bore 9 of the bit shaft and is integral with a valve cone 11. The valve cone 11 is pressed against the valve seat 13 by means of a spring 12. Simultaneously, the bit 6 is via the push rod 10 loaded in opposite direction to the cutting pressure so that the bit 6 is, in non-operative condition, lifted off a shoulder 14 of the bit shaft for a distance a. As soon as there becomes effective the cutting pressure, the valve cone 11 is lifted off its seat against the force of the spring 12 and the bit 6 is then seated on the shoulder 14.

15 is a bore provided within the bit holder and serving the purpose of supplying cooling water. The cooling water flows via an annular grove 16 within the bit shaft and via bores 17 into an annular space 18 and further via bores 19 within a tubular valve housing 20 into the space 21 of the valve housing 20. 22 is an annular filter enclosing the valve housing 20 at the area of the bores 19. If the valve cone 11 is lifted off its seat, the cooling water flows into the space 23 located down stream of the valve cone 11 and further flows via bores 24 and an annular groove 25 to a bore 26 provided within the bit shaft 3, from where the cooling water arrives at a nozzle 30 via an annular groove 27 and bores 28, 29.

A sealing ring 32 is placed into a groove 21 of the push rod 10. This sealing ring, which for example consists of hard synthetic plastics material, is slotted at its circumference so that a minor amount of water can flow out of the space 23. The push rod 10 is untightly guided within the bore 9 of the bit shaft 3 so that a minor amount of water can, via the slot provided in the sealing ring 32, flow into the space 33 existing between the bit shaft 3 and the bit 6. This water can emerge at 35 via the annular gap 34 existing between the bit shaft 3 at the bit 6 so that this annular gap 34 is subjected to rinsing.

36 is a thread by means of which the valve housing 20 is screwed into the bit shaft 3.

What is claimed is:

1. A cutting assembly having at least one nozzle for directing a coolant to the work area, the coolant supply being dependent on the application of pressure to the assembly, the assembly comprising a cap-shaped cutting bit, a bit holder having a shaft to receive said bit, the bit being capable of limited axial movement on said shaft, a shutoff valve for the coolant within said shaft, a coupling member connecting the valve with the bit such that the valve opens on axial movement of the bit when cutting pressure is applied.

2. A cutting assembly according to claim 1 wherein the coolant nozzle is positioned adjacent the cutting bit.

3. A cutting assembly according to claim 1 wherein a coolant supply passage is provided within the shaft to communicate the valve with a coolant supply.

4. A cutting assembly according to claim 1 wherein the valve is urged in the closed position by a spring acting against the shaft and the valve.

5. A cutting assembly as claimed in claim 1, characterized in that the shutoff valve becomes closed in the direction of the acting cutting pressure and that the bit shaft has a central bore within which a push rod forming the coupling member is guided for axial movement, said push rod acting on a movable closure member of the valve and preferably being integral with said closure member.

6. A cutting assembly as claimed in claim 5, characterized in that the push rod is axially guided within the bore of the bit shaft and within a guide bore of the valve housing.

7. A cutting assembly as claimed in claim 5, characterized in that a slotting ring is inserted between the push rod and the guide bore of the valve housing, the slit of said slotted ring providing a flow passage for the water.

8. A cutting assembly as claimed in claim 1, characterized in that a tubular valve housing is inserted into a central bore of the bit shaft.

9. A cutting assembly for a rock-cutting machine comprising: a bit shaft inserted into and supported by a bit holder; a cap-shaped bit mounted around said bit shaft for rotation relative to said shaft and for limited axial movement relative to said shaft, said shaft having a bore within which is located a normally closed coolant control valve; means within said bore responsive to axial movement to said bit upon application of cutting pressure to said bit for opening said valve; and coolant passage means for supplying coolant to said valve and for conducting coolant from said valve, when open, to said nozzle.

10. A cutting assembly as in claim 9 wherein said means for opening said valve includes a push rod having an outer end in engagement with said bit and a spring biasing said push rod and bit in an outward direction whereby application of cutting pressure to said bit moves said push rod inwardly against the bias force of the spring.

11. A cutting assembly as in claim 10 wherein said valve includes a movable closure member integral with said push rod.

* * * * *